United States Patent [19]

Eger et al.

[11] Patent Number: 4,797,971

[45] **Date of Patent: * Jan. 17, 1989**

[54] ADJUSTING DEVICE FOR A VEHICLE DOOR

[75] Inventors: Georg Eger, Hochdorf; Rainer Srock, Leonberg, both of Fed. Rep. of Germany

[73] Assignee: Dr. Ing. h.c.F. Porsche Aktiengesellschaft, Stuttgart, Fed. Rep. of Germany

[ * ] Notice: The portion of the term of this patent subsequent to Sep. 1, 2004 has been disclaimed.

[21] Appl. No.: 7,361

[22] Filed: Jan. 27, 1987

[30] Foreign Application Priority Data

Jan. 28, 1986 [DE] Fed. Rep. of Germany ..... 3602405

[51] Int. Cl.[4] ..... E05F 5/02; E05F 3/12

[52] U.S. Cl. ..... 16/82; 16/58; 16/DIG. 10; 16/DIG. 17; 188/288; 188/318

[58] Field of Search ..... 188/284, 288, 318; 16/51, 58, 66, 84, 82, DIG. 9, DIG. 10, DIG. 17, 85

[56] References Cited

U.S. PATENT DOCUMENTS

| | | | |
|---|---|---|---|
| 2,036,474 | 4/1936 | Hanson | 16/84 |
| 2,117,060 | 5/1968 | Gouse | 16/84 |
| 2,834,039 | 5/1958 | Sasse | 16/51 |
| 3,062,331 | 11/1962 | Wyman | 188/288 |
| 3,212,122 | 10/1965 | Flint | 16/51 |
| 4,113,071 | 9/1978 | Müller et al. | 296/56 |
| 4,433,759 | 2/1984 | Ichinose | 16/51 |
| 4,689,849 | 9/1987 | Eger et al. | 16/82 |

FOREIGN PATENT DOCUMENTS 2555062 8/1977 Fed. Rep. of Germany .

*Primary Examiner*—Fred A. Silverberg
*Assistant Examiner*—Edward A. Brown
*Attorney, Agent, or Firm*—Barnes & Thornburg

[57] ABSTRACT

A control mechanism for a door of a motor vehicle is described that is actuated via an inside and outside handle and comprises a piston-cylinder unit arranged between a door post and the vehicle door. It has a piston provided with passage openings for a pressure medium, the piston interacting with an interior valve that separates two working chambers of the cylinder from one another. The control mechanism is equipped with a blocking valve controlling the medium flow, this blocking valve being arranged in a control circuit connecting the two working chambers of the cylinder, acting against the flow direction. This blocking valve, via a control element at a door handle, can be controlled in such a way that the door is blocked in at least one intermediate position. The cylinder has at least one overflow duct between the two working chambers, the flow-through of which is controlled by the piston of the unit. The duct extends over an area into which the piston dips, up to a door opening angle of about 30°, during the initial opening of the door from the closed position. This opens the duct between the working chambers and an unhindered opening of the door becomes possible without an actuating of the door handle.

9 Claims, 2 Drawing Sheets

ADJUSTING DEVICE FOR A VEHICLE DOOR

BACKGROUND AND SUMMARY OF THE INVENTION

The present invention relates to a type of control mechanism for a motor vehicle door that can block the door in at least one intermediate position.

German Patent Application P No. 35 19 203.8, which corresponds to commonly assigned pending U.S. application Ser. No. 850,004, now U.S. Pat. No. 4,689,849, describes a control mechanism for a vehicle door that permits an immediate arresting of the opening vehicle door in any intermediate position through the operation of an inside or outside handle. This control mechanism is designed such that when the handle is operated in the opening direction, the door opens easily. On the other hand, when the handle is operated in the closing direction, the door can be arrested in any arbitrary intermediate position via the control mechanism. A closing of the door takes place easily without operating the handle and no arresting in an intermediate position is possible.

For the simple operating of a door in the range of small opening angles during the initial opening of the door, it is an objective of the present invention to provide a control mechanism by means of which, while the arresting of the door is maintained, an easy, unimpaired opening of the door is also possible.

This and other objectives are achieved by the present invention by providing in a control mechanism of a motor vehicle door, a piston-cylinder unit arranged between the door post and the vehicle door for dampening door opening and closing movements. The piston-cylinder unit exhibit passage openings and communicate two working chambers of opposite effective pressure surfaces of the piston-cylinder unit. Interior valves control the passage openings in response to relative movement of the vehicle door and door post. A control circuit connects the two working chambers separately from the passage openings. The control circuit includes blocking valves controlled by the door handles in such a way that the door can be blocked in at least one intermediate position. Lastly, the present invention includes an overflow duct which fluidly connects the two working chambers when the door is within a predetermined opening range, irrespective of the blocking valve.

In the mechanism according to pending U.S. application Ser. No. 850,004, the door, via the control mechanism, can be arrested during the opening in any arbitrary intermediate position and therefore also during the initial opening when there is a small opening angle. In order for the door to be opened, while the blocking is eliminated, an overflow duct is provided in the present invention between the two working chambers in the cylinder. When the door is opened from the closed position, the piston of the unit dips into this duct and permits an unimpaired exchange of medium between the two working chambers. It is only after a certain opening angle of the door is reached that the blocking is actuated via the control mechanism. In other words, the door handle must be operated again. The angle for the unblocked opening of the door without the operation of the inside handle of the door should be about 30°, so that an unhindered exiting from the vehicle is possible for an average person. It was found even at a door opening angle of about 20°, that optimal conditions are met for the exiting of an average person.

Other objects, advantages and novel features of the present invention will become apparent from the following detailed description of the invention when considered in conjunction with the accompanying drawings.

DETAILED DESCRIPTION OF THE DRAWINGS

Figure 2:
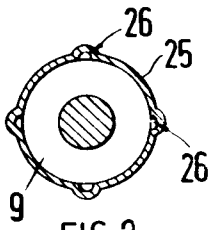
FIG. 2 is a sectional view taken along Line II—II of FIG. 1.

The mechanism 1 comprises a piston-cylinder unit 2 that has a control circuit 3 in which a blocking valve 4 is arranged. This valve may be arranged inside or outside the unit 2. The unit 2 is held between a door 5 and a console 6 on the side of the vehicle body so that it can be pivoted around vertical shafts 7, 7*a*. The piston rod is connected by shaft 7*a*, for example, with a hinge 22 of the door 5.

When the door 5 is swung in the direction of the Arrow 8*a* (opening), a piston 9 of the unit 2 is moved in the direction of the Arrow 10. When the door 5 is swung in the direction of the Arrow 8 (closing), the piston 9 is moved in the direction of the Arrow 11. This piston 9 has passage openings 12 for a pressure medium, such as gas, hydraulic oil or a similar medium. The openings 12 in the piston 9 are exposed or closed by an interior valve 13 controlled by a spring 14 as a function of the movement of the door.

The line of the mechanism 1 forming the control circuit 3 with its inlet and outlet leads into the cylinder 25, which is divided by the piston 9 into working chambers 15 and 16. The blocking valve 4 is arranged in the control circuit 3 so that it acts against the flow direction 17. It is movable into a closing position (direction of the Arrow 23) and into a release position (direction of the Arrow 24) as a function of the operating of a door handle via mechanical control means 18. The blocking valve 4 is connected with the inside handle and the outside handle of the door via mechanical control means 18 which may be sheathed or Bowden cables, for example. The blocking valve 4 can be adjusted via each handle to the release and the closing positions.

Figure 1:
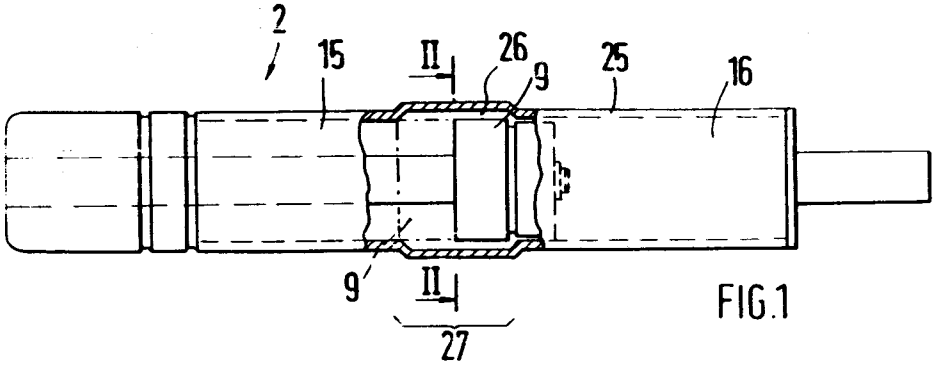
FIG. 1 is a partial sectional view of a control mechanism constructed in accordance with a preferred embodiment of the present invention.
Figure 3:
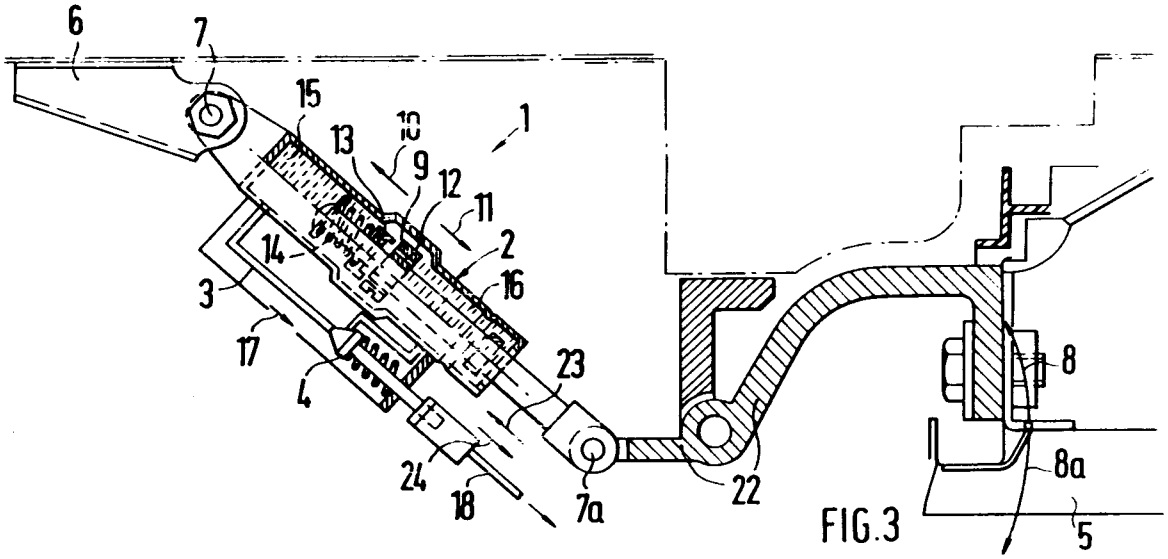
FIG. 3 is a view of the control mechanism of FIG. 1 when the door is closed.
Figure 4:
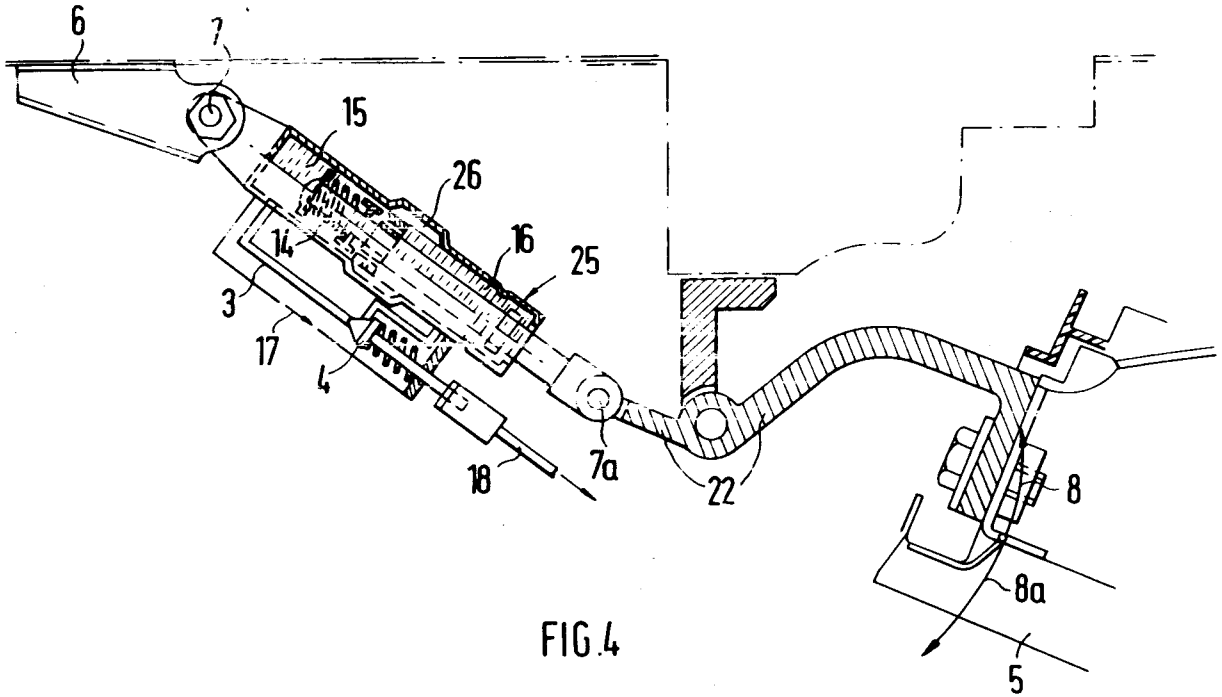
FIG. 4 is a view of the control mechanism when the door is opened by about 30°.

FIG. 1 shows in detail a preferred embodiment, in which the cylinder 25 of the unit 2 has an overflow duct 26 between the two working chambers 15 and 16. This duct 26 extends over a range 27 that corresponds to an opening angle of the door of $\alpha=0°$ to 30° so that the piston 9 at these opening angles is inside the duct 26. When the piston 9 is immersed in the duct 26, the medium can overflow unimpaired from one working chamber 15 into the other working chamber 16 without a blocking of the door 5 taking place. It is only when the piston 9 has reached the dash-dotted position in FIG. 1, that the duct 2 is blocked as shown in FIG. 4, and the door 5 can no longer be opened in an unimpaired way. A further opening of the door 5 can take place only when a door handle is pulled so that the valve 4 is moved in the direction of the Arrow 24 for opening.

The method of operation of the mechanism is as follows: The door 5 is opened by a pulling of the inside or outside handle. In the process, the valve 4 is pulled from its closing position into the release position in the control circuit 3 so that an unhindered opening becomes possible. When the door handle is no longer pulled, the valve 4 takes up a blocking position and the door is arrested in its momentary position. Due to the overflow duct, the door is freely opened up to an angle of about $\alpha=30°$, irrespective of the actuating of the door handle. This is because the piston 9 does not block fluid communication between the two chambers 15 and 16 up to this angle and thus a free flow of medium is ensured between the chambers 15 and 16. As shown in a preferred embodiment illustrated in FIG. 2, a plurality of overflow ducts 26 may be arranged so that they are evenly distributed over the circumference of the cylinder 25 of the unit 2. However, it is also contemplated to provide only one overflow duct 26 per cylinder.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. A control mechanism for a motor vehicle door that is actuated via an inside and outside handle and comprises a piston-cylinder unit arranged between a door post and the vehicle door, said piston-cylinder unit having a piston equipped with passage openings for a pressure medium, said piston interacting with an interior valve separating two working chambers of the cylinder with respect to one another, and the control mechanism being equipped with a blocking valve controlling the flow of medium, said blocking valve being arranged in a control circuit connecting the two working chambers of the cylinder so that said blocking valve acts against the flow direction and is controllable via control means at a door handle in such a way that the door is blocked in at least one intermediate position, wherein:

the cylinder has at least one overflow duct between the two working chambers, the flow-through of which is controlled by the piston of the unit, and in that the duct extends over a range into which the piston immerses during the initial opening of the door from the closed position and opens the duct between the working chambers.

2. A mechanism according to claim 1, wherein the overflow duct connects the two working chambers with one another up to an opening angle of the door of between $\alpha=0°$ to 30° so that the medium can flow through and in that, when a maximum door opening angle of $\alpha=30°$ is exceeded, the piston blocks the overflow duct.

3. A mechanism according to claim 2, wherein several overflow ducts are arranged and distributed at the circumference of the cylinder.

4. A control mechanism for a motor vehicle door of the type which is swingably linked to a vehicle body door post and includes interior and exterior door handles said control mechanism comprising:

a piston-cylinder unit arranged between the door post and the vehicle door for dampening door opening and closing movements, said piston-cylinder unit exhibiting passage opening means and communicating two working chambers of opposite effective pressure surfaces of the piston-cylinder unit and interior valve means controlling the passage opening means in response to relative movement of the vehicle door and door post, control circuit means connecting the two working chambers separately from the passage opening means, said control circuit means including blocking valve means controlled by the door handles in such a way that the door can be blocked in at least one intermediate position, and overflow duct means for fluidly connecting said two working chambers when the door is within a predetermined opening range, irrespective of said blocking valve means.

5. A mechanism according to claim 4, wherein flow through said overflow duct means is controlled by a piston of said piston-cylinder unit.

6. A mechanism according to claim 5, wherein said overflow duct means is integral with a cylinder of said piston-cylinder unit.

7. A mechanism according to claim 6, wherein said overflow duct means connects said working chambers when said piston is within said overflow duct means.

8. A mechanism according to claim 6, wherein said piston-cylinder unit has a plurality of said overflow duct means.

9. A mechanism according to claim 4, wherein said predetermined opening range is between 0° and 30°.

* * * * *